US011020964B2

(12) United States Patent
Korthuis et al.

(10) Patent No.: US 11,020,964 B2
(45) Date of Patent: Jun. 1, 2021

(54) MODIFYING A FIRING EVENT SEQUENCE WHILE A FLUID EJECTION SYSTEM IS IN A SERVICE MODE

(71) Applicant: HEWLETT-PACKARD DEVELOPMENT COMPANY, L.P., Spring, TX (US)

(72) Inventors: Vincent C Korthuis, Corvallis, OR (US); James Gardner, Corvallis, OR (US); Eric T Martin, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/482,763

(22) PCT Filed: Apr. 10, 2017

(86) PCT No.: PCT/US2017/026865
§ 371 (c)(1),
(2) Date: Aug. 1, 2019

(87) PCT Pub. No.: WO2018/190798
PCT Pub. Date: Oct. 18, 2018

(65) Prior Publication Data

US 2020/0031121 A1 Jan. 30, 2020

(51) Int. Cl.
*B41J 2/04* (2006.01)
*B41J 2/045* (2006.01)

(52) U.S. Cl.
CPC ..... *B41J 2/04551* (2013.01); *B41J 2/04581* (2013.01)

(58) Field of Classification Search
None
See application file for complete search history.

(56) References Cited

U.S. PATENT DOCUMENTS

| | | | |
|---|---|---|---|
| 8,282,203 | B2 | 10/2012 | Brenner et al. |
| 9,085,163 | B2 | 7/2015 | Sunouchi et al. |
| 2002/0063745 | A1 | 5/2002 | Osborne |

(Continued)

FOREIGN PATENT DOCUMENTS

| | | |
|---|---|---|
| EP | 1356946 A1 | 10/2003 |
| EP | 1359027 | 11/2003 |

(Continued)

OTHER PUBLICATIONS

Webpage. HP45 Inkjet Printhead, < ytec3d.com/hp45-inkjet-printhead/ >.

*Primary Examiner* — Erica S Lin
(74) *Attorney, Agent, or Firm* — HP Inc. Patent Department

(57) ABSTRACT

A fluid ejection system includes a group of actuators and a controller. The controller can determine an operational mode of the fluid ejection system. Examples of operational modes include a service mode. In response to determining the fluid ejection system is in the service mode, the controller can modify a firing event sequence of each actuator in the group of actuators. The modification of the firing event sequence can be based in part on determining the fluid ejection system is operating in the service mode.

20 Claims, 9 Drawing Sheets

(56) References Cited

U.S. PATENT DOCUMENTS

| | | | | |
|---|---|---|---|---|
| 2008/0238974 | A1* | 3/2008 | Takahashi | B41J 29/38 347/14 |
| 2009/0160898 | A1 | 6/2009 | Bergstedt et al. | |
| 2010/0012377 | A1 | 1/2010 | Sharp et al. | |
| 2010/0079559 | A1* | 4/2010 | Justice | B41J 2/17506 347/85 |
| 2010/0123747 | A1* | 5/2010 | McReynolds | B41J 2/16523 347/14 |
| 2010/0149238 | A1* | 6/2010 | Garbacz | B41J 2/105 347/10 |
| 2010/0231644 | A1* | 9/2010 | Otokita | B41J 19/142 347/37 |
| 2011/0234703 | A1* | 9/2011 | Kodoi | B41J 2/05 347/61 |
| 2013/0010036 | A1 | 1/2013 | Conner et al. | |
| 2013/0057622 | A1* | 3/2013 | Govyadinov et al. | B41J 2/175 347/85 |
| 2013/0176359 | A1 | 7/2013 | Roberts et al. | |

FOREIGN PATENT DOCUMENTS

| | | | |
|---|---|---|---|
| WO | WO-2016089367 | A1 | 6/2016 |
| WO | WO-2016171728 | | 10/2016 |
| WO | WO-2016175812 | | 11/2016 |

* cited by examiner

MODIFYING A FIRING EVENT SEQUENCE WHILE A FLUID EJECTION SYSTEM IS IN A SERVICE MODE

BACKGROUND

Fluid ejection dies may be implemented in fluid ejection devices and/or fluid ejection systems to selectively eject/dispense fluid drops. Example fluid ejection dies may include nozzles, ejection chambers and fluid ejectors. In some examples, the fluid ejectors may eject fluid drops from an ejection chamber out of the orifice.

BRIEF DESCRIPTION OF THE DRAWINGS

The disclosure herein is illustrated by way of example, and not by way of limitation, in the figures of the accompanying drawings in which like reference numerals refer to similar elements, and in which.

Figure 1:
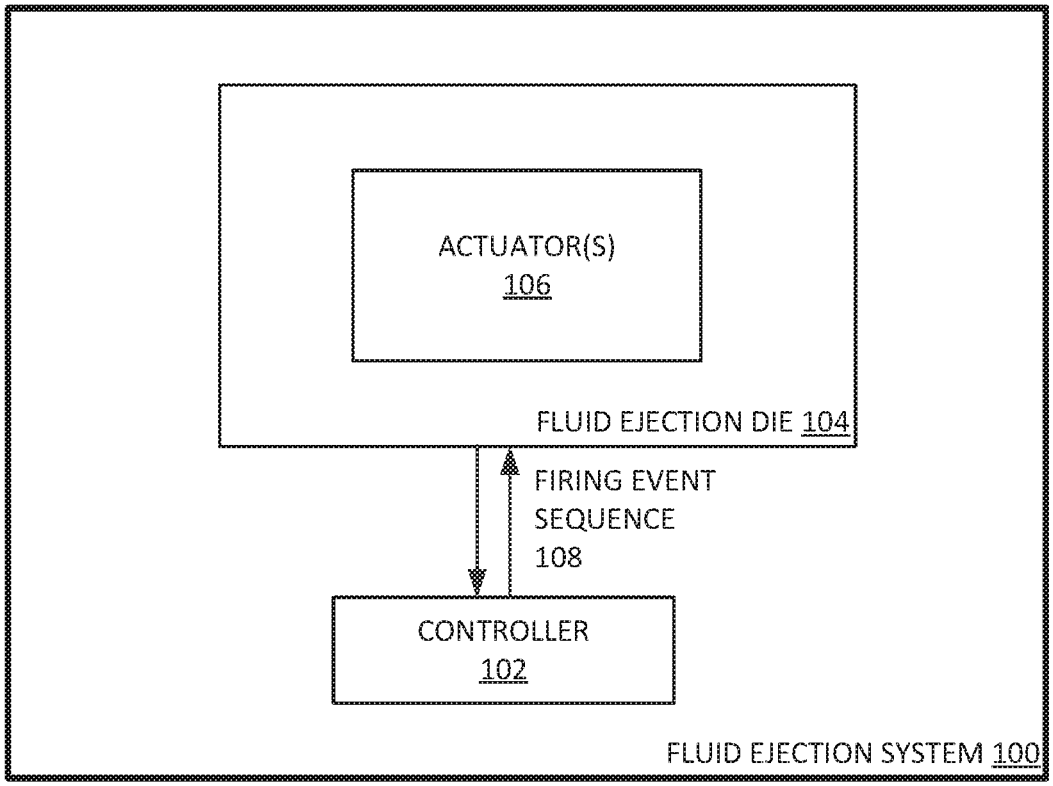
FIG. 1 illustrates an example fluid ejection system to purge fluid from the fluid ejection system during a servicing mode.

Throughout the drawings, identical reference numbers designate similar, but not necessarily identical elements. The figures are not necessarily to scale, and the size of some parts may be exaggerated to more clearly illustrate the example shown. Moreover the drawings provide examples and/or implementations consistent with the description. However, the description is not limited to the examples and/or implementations provided in the drawings.

DETAILED DESCRIPTION

Examples provide for a fluid ejection system to modify a firing event sequence of a group of fluidic actuators of a fluid ejection die to increase the efficiency for purging fluid (e.g., shipping fluid or ink) from the fluid ejection system. In some examples, the fluid ejection system can purge fluid when the fluid ejection system is operating in a servicing mode. In some examples, a fluid ejection system can modify a firing event sequence based on a fluidic actuator type of each fluidic actuator. In other examples, a fluid ejection system can modify a firing event sequence based on a column and/or fluidic actuator group of a fluid ejection die each fluidic actuator is associated with. In yet other examples, a fluid ejection system can modify a firing event sequence based on a fluidic actuator type and a column and/or fluidic actuator group of a fluid ejection die each fluidic actuator is associated with.

Examples as described recognize that a fluid ejection system (e.g., a printer system) can include shipping fluid. Shipping fluid is fluid that can help maintain functionality of each fluidic actuator of a fluid ejection die (e.g., a print-head die). For example, shipping fluid can ensure that a orifice or a chamber of an fluidic actuator does not dry out prior to the first installation of the fluid ejection system. However, the fluid ejection systems do not utilize shipping fluid during normal operations. As such, in some examples, the fluid ejection systems may purge shipping fluid before initiating a normal mode of operations (e.g., during a servicing mode). Current implementations for a fluid ejection system to purge shipping fluid can be overly time consuming and inefficient in the utilization of the resources of the fluid ejection system. Among other benefits, examples are described that enable the fluid ejection system to modify a firing event sequence of a group of fluidic actuators of a fluid ejection die to increase the efficiency for purging shipping fluid from the fluid ejection system. The fluid ejection system can purge shipping fluid when the fluid ejection system is operating in a servicing mode.

System Description

FIG. 1 illustrates an example fluid ejection system to purge fluid from the fluid ejection system during a servicing mode. As illustrated in FIG. 1, fluid ejection system 100 can include controller 102 and fluid ejection die 104. Controller 102 can implement processes and other logic to manage operations of the fluid ejection system 100. For example, controller 102 can transmit firing event sequence 108 to control fluid ejection die 104 to fire/eject/recirculate fluid out of fluidic actuator(s) or actuator(s) 106. As herein described, any fluid (e.g., ink or shipping fluid), can be fired out of actuator(s) 106. In some examples, controller 102 can transmit firing event sequence 108 to control fluid ejection die 104 to purge fluid (e.g., shipping fluid) out of fluid ejection die 104. In other examples, controller 102 can modify firing event sequence 108 to increase the efficiency for purging shipping fluid from fluid ejection die 104. Additionally, in a variation of such examples, firing event sequence 108 is associated with a normal mode of operations. In some examples, controller 104 can include a processor to implement the described operations of fluid ejection system 100.

Actuator(s) 106 can include a nozzle or an orifice, a chamber and an actuator component or element. Each actuator 106 can receive fluid from a fluid reservoir. In some examples, the fluid reservoir can be ink feed holes or an array of ink feed holes. In some examples, the fluid can be ink (e.g., latex ink, synthetic ink or other engineered fluidic inks). In other examples, the fluid can be shipping fluid. Each actuator 106 can be associated or assigned to an identifier. For example, each actuator 106 can be assigned an address.

Fluid ejection system 100 can fire fluid from the orifice of actuator(s) 106 by forming a bubble in the chamber of actuator(s) 106. In some examples, the fluid ejection component can include a actuator element. Controller 102 of fluid ejection system 100 can drive a signal to fluid ejection component to drive/eject the fluid out of the orifice of actuator(s) 106.

In some examples, firing event sequence 108 can specify which actuator 106 is to eject/recirculate fluid. For example, firing event sequence 108 can include firing instructions or firing data packets. Each firing data packet can include firing data that can control fluid ejection die 104 to drive a signal (e.g., power from a power source or current from the power source) to the fluid actuator element to fire/eject the fluid in the chamber of actuator 106. Furthermore, the firing data packets can include specific addresses or identifiers that are associated with specific actuator(s) 106. As such, identifiers or addresses included in the firing data packets can instruct fluid ejection die 104 which specific actuator is to eject/recirculate. In some examples, controller 102 can transmit firing event sequence 108 to control fluid ejection die 104 the order or sequence each actuator 106 is to fire/eject/recirculate fluid.

In some examples, fluid ejection die 104 can include multiple actuator groups. In such examples, controller 102 can transmit firing event sequence 108 to each actuator group of fluid ejection die 104. In response to each actuator group of fluid ejection die 104 receiving the firing event sequence 108, the each actuator group can determine which actuator to fire and/or in what order each actuator is to fire. In a variation of such examples, each actuator group of fluid ejection die 104 may determine which actuator within the actuator group is to fire and in which order based on the address conveyed by controller 102 on firing event sequence 108.

Fluid ejection system 100 can have multiple operational modes. For example, fluid ejection system 100 can operate in a normal mode. In other examples, fluid ejection system 100 can operate in a service mode. Fluid ejection system 100 can purge fluid (e.g., shipping fluid) out of the orifices of each actuator from fluid ejection die 104 when fluid ejection system 100 is operating in a service mode. For example, controller 102 can determine the operational mode fluid ejection system 100 is operating in. In response to controller 102 determining fluid ejection system 100 is operating in a service mode, controller 102 can transmit firing event sequence 108 to control fluid ejection die 104 to purge fluid from fluid ejection die 104. In response to fluid ejection die 104 receiving firing event sequence 108, fluid ejection die 104 can drive a signal to actuator(s) 106 to fire/eject fluid. In some examples, controller 102 can modify firing event sequence 108 that is associated with a normal mode and transmit the modified firing event sequence 108 to fluid ejection die 104 to control fluid ejection die 104 to purge fluid.

In some examples, fluid ejection system 100 can have multiple service modes and each service mode could correspond to a purging of a different type of fluid. For example, a first service mode can correspond to controller 102 instructing fluid ejection die 104 to purge shipping fluid. Additionally, a second service mode can correspond to controller 102 instructing fluid ejection die 104 to purge ink. Additionally, in such examples, fluid ejection system 100 can modify a firing event sequence of a group of fluidic actuators 106 to increase the efficiency for purging fluid in each service mode.

Figure 2A:
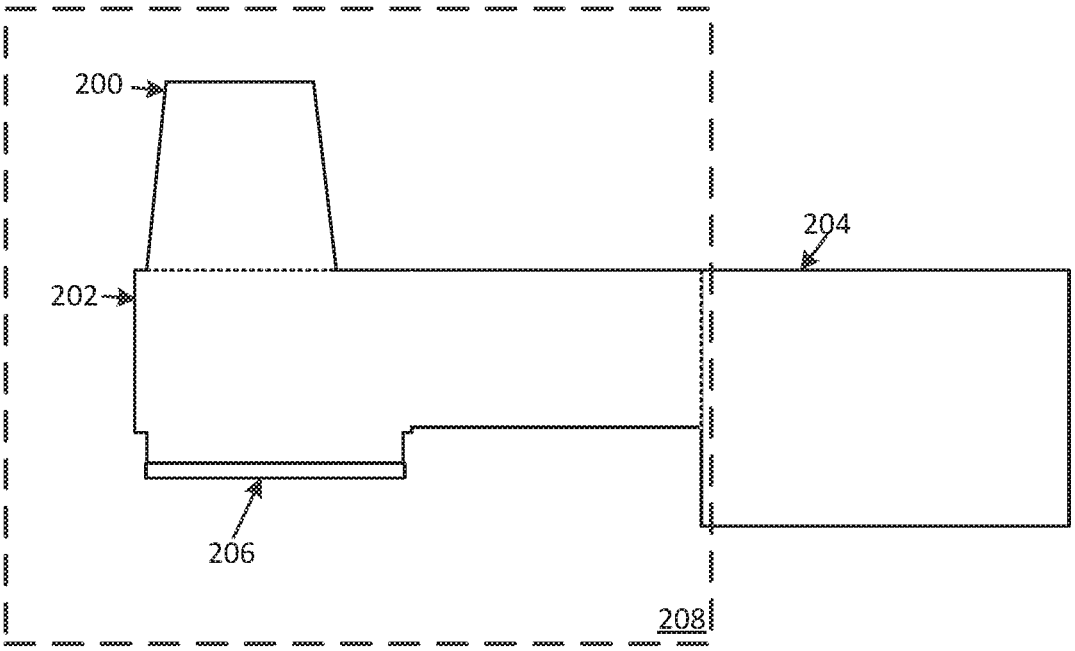
FIG. 2A illustrates an example cross-sectional view of an example ejector type actuator.

FIG. 2A illustrates an example cross-sectional view of an example ejector type actuator. As illustrated in FIG. 2A, actuator 208 includes orifice 200, chamber 202, and fluid actuator element 206. In some examples, as illustrated in FIG. 2A, fluid actuator element 206 may be disposed proximate to ejection chamber 202.

In some examples, actuator 208 can be a fluid ejector type. The fluid ejector type actuator 208 can eject drops of fluid from chamber 202 through an orifice 200 by fluid actuator element 206. Examples of fluid actuator element 206 of a fluid ejector type actuator 208 include a thermal resistor based actuator, a piezo-electric membrane based actuator, an electrostatic membrane actuator, magnetostrictive drive actuator, and/or other such devices.

In examples in which fluid actuator element 206 may include a thermal resistor, a controller (e.g., controller 102) can control the fluid ejection die to drive a signal (e.g., power from a power source or current from the power source) to electrically actuate fluid actuator element 206. In such examples, the electrical actuation of fluid actuator element 206 can cause formation of a vapor bubble in fluid proximate to fluid actuator element 206 (e.g., chamber 202). As the vapor bubble expands, a drop of fluid may be displaced in chamber 202 and ejected through the 200. In this example, after ejection of the fluid drop, electrical actuation of fluid actuator element 206 may cease, such that the bubble collapses. Collapse of the bubble may draw fluid from fluid reservoir 204 into chamber 202. In this way, in such examples, a controller (e.g., controller 102) can control the formation of bubbles in chamber 202 by time (e.g., the time for which the actuator element is actuated) or by signal magnitude or characteristic (e.g., different levels of power).

In examples in which the fluid actuator element 206 includes a piezoelectric membrane, a controller (e.g., controller 102) can control the fluid ejection die to drive a signal (e.g., power from a power source or current from the power source) to electrically actuate fluid actuator element 206. In such examples, the electrical actuation of fluid actuator element 206 can cause deformation of the piezoelectric membrane. As a result, a drop of fluid may be ejected out of the orifice or bore of orifice 200 due to the deformation of the piezoelectric membrane. Returning of the piezoelectric membrane to a non-actuated state may draw additional fluid from fluid reservoir 204 into chamber 202.

In some examples, the fluid ejector type actuator 208 can be a HDW (high drop weight) fluid ejector type actuator 208. In other examples, the fluid ejector type actuator 208 can be a LDW (low drop weight) fluid ejector type actuator 208. In some examples, the HDW fluid ejector type actuator 208 can include orifice 200 with a larger orifice or different orifice geometry to eject higher weighted or larger sized fluid drops than the LDW fluid ejector type actuator 208. In other examples, the HDW fluid ejector type actuator 208 can utilize more power to eject higher weighted or larger sized fluid drops than the LDW fluid ejector type actuator 208. In yet other examples the HDW fluid ejector type actuator 208 can utilize more power and can include a larger orifice or different orifice geometry to eject higher weighted fluid drops than the LDW fluid ejector type actuator 208.

In some examples, the fluid ejection die can include LDW fluid ejector type actuator 208. In other examples, the fluid ejection die can include HDW fluid ejector type actuator 208. In yet other examples, a fluid ejection die can include both a HDW fluid ejector type actuator 208 and a LDW fluid ejector type actuator 208.

Figure 2B:
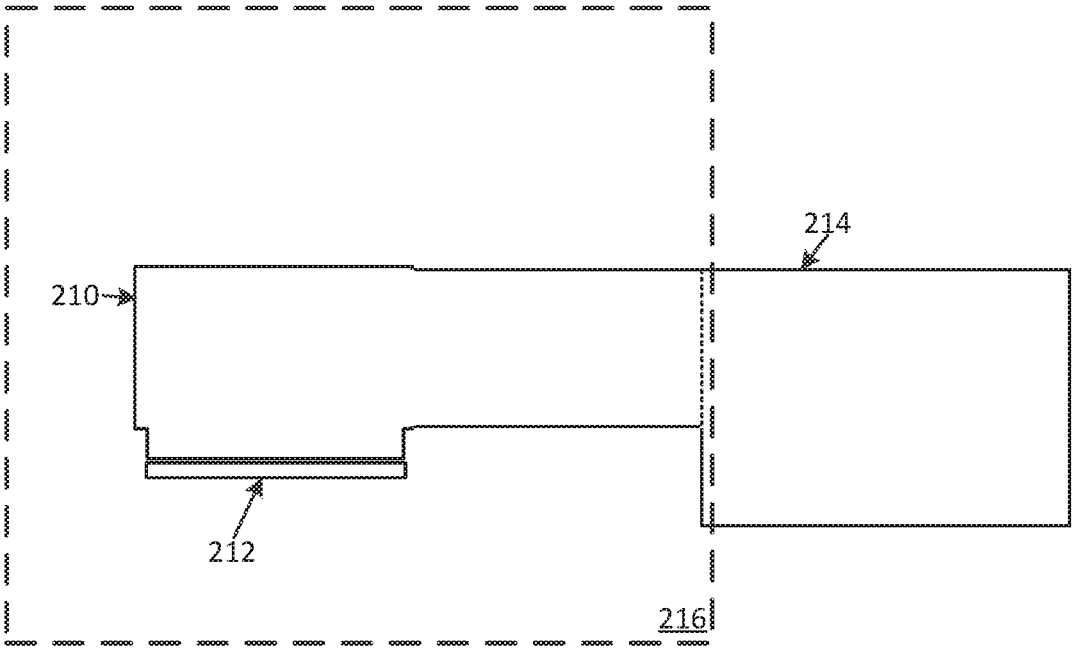
FIG. 2B illustrates an example cross-sectional view of an example recirculation type actuator.

In some examples, the actuator can be a recirculation type actuator. FIG. 2B illustrates an example cross-sectional view of an example recirculation type actuator. The recirculation type actuator 216 may recirculate or pump fluid within one or more chambers 210 when fluid actuator element 212 fires. In such examples, recirculation type actuator 216 does not include an orifice (e.g., orifice 200 of FIG. 2A) 200. Similar to the fluid ejector type actuator 208, examples of actuator element 212 of a recirculation actuator type actuator 216, can include a thermal resistor based actuator, a piezo-electric membrane based actuator, an electrostatic membrane actuator, magnetostrictive drive actuator, and/or other such devices.

Figure 3:
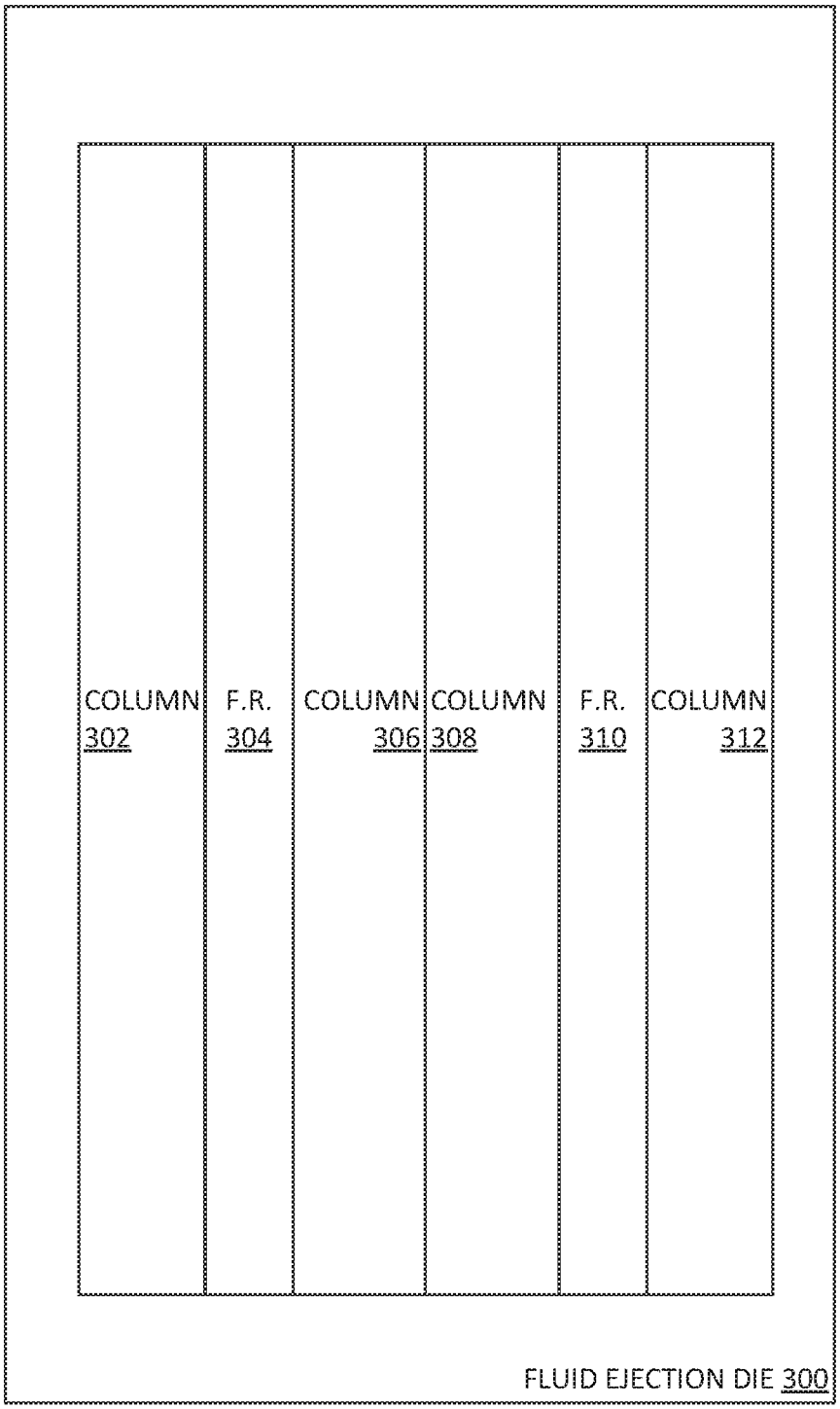
FIG. 3 illustrates an example fluid ejection die with multiple columns of actuators.

A fluid ejection die (e.g., fluid ejection die 104) can include multiple columns of actuators (e.g., actuator(s) 106). For example, FIG. 3 illustrates an example fluid ejection die with multiple columns of actuators. As illustrated in FIG. 3, fluid ejection die 300 can include columns 302, 306, 308 and 312. Furthermore, as illustrated in FIG. 3, F.R. (fluid reservoir) 304 is operatively coupled to column 302 and column 306 and F.R. 310 is operatively coupled to column 308 and column 312. In some examples, a fluid ejection die can have multiple columns of actuators and each column of actuators can have multiple groups of actuators. For example, column 302, column 306, column 308 and column 312 can each include multiple groups of actuator(s). In other examples, a fluid ejection die can include a column of multiple groups of actuator. In some examples, a fluid ejection die can include a column of actuators. In other examples, a fluid ejection die can have an array of actuators. In yet other examples, a fluid ejection die can include F.R. 304 and 310 are ink feed holes.

In some examples, the identifier or address of each actuator (e.g., actuator(s) 106) can be based on the location of the actuator on the fluid ejection die. For example, the address of each actuator can be based on the row of the column that each actuator is located on. In another example, the address of each actuator can be based on which column each actuator is located on. In some examples, actuators on a fluid ejection die can share addresses or identifiers. For example, a fluid ejection die can include multiple columns of actuators and each column includes multiple groups of actuators. In such an example, each actuator group has a single column of actuators. Furthermore, each actuator of each actuator group with the same row location can be assigned the same address.

The fluid ejection system (e.g., the controller) can modify the firing event sequence associated with a normal mode of operations based on the actuator type of the actuator to more efficiently purge fluid out of the fluid ejection system. For example, a controller (e.g., controller 102) can determine, for each firing data packet of a firing event sequence, the actuator type associated with the address or identifier of each actuator (e.g., whether the actuator is a fluid ejector actuator, a recirculation actuator, high drop weight actuator or a low drop weight actuator). Additionally, the controller can modify the firing event sequence associated with a normal mode of operations, by removing or adding a firing data packet to the firing event sequence, based on the determined type of actuator. In some examples, the controller can add an additional address associated with an actuator to a firing data packet of a firing event sequence.

Figure 4:
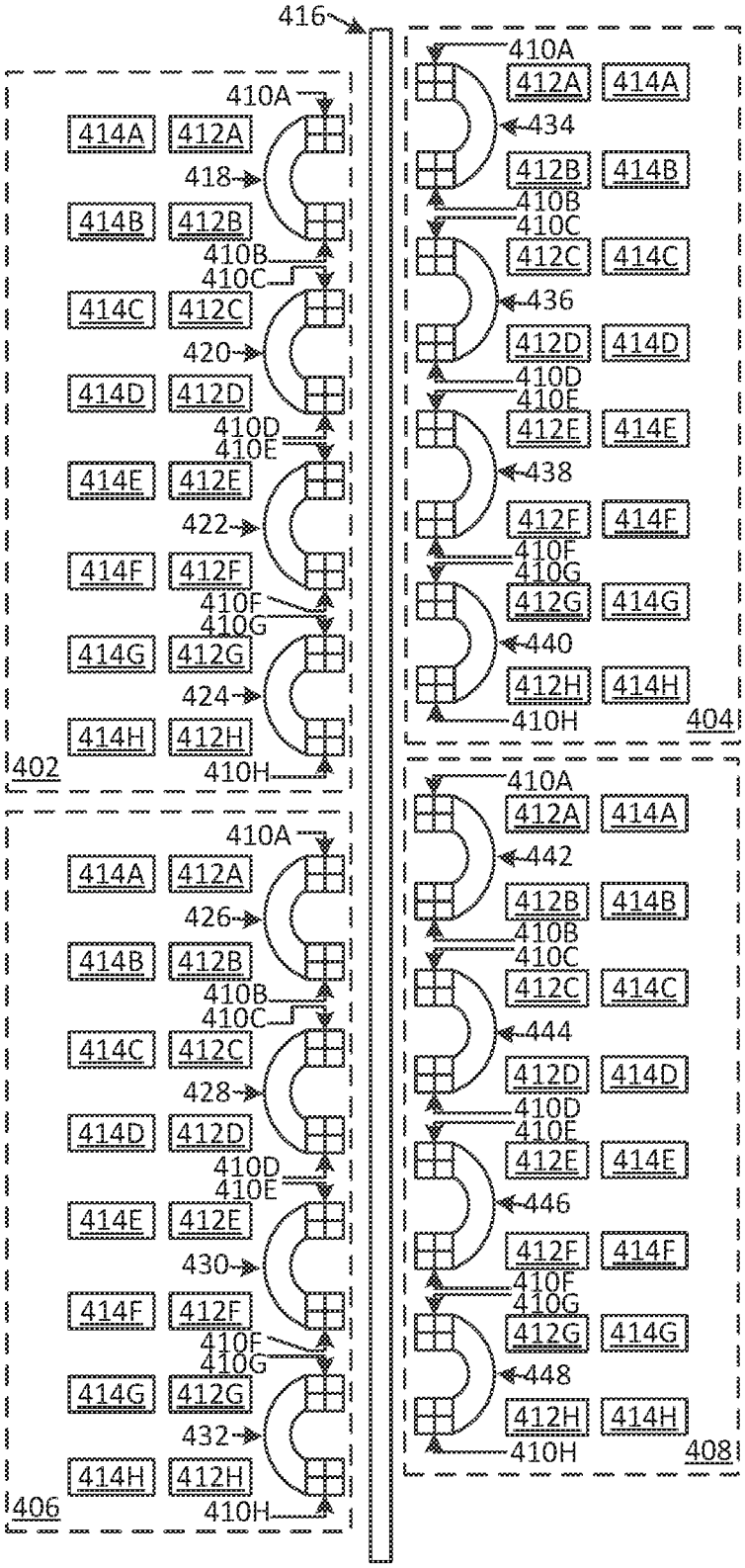
FIG. 4 illustrates an example portion of a fluid ejection die with fluid ejector type actuators and recirculation type actuators.

In some examples, a fluid ejection system undergoing going fluid purge, may include a fluid ejector type actuator and a type recirculation actuator. FIG. 4 illustrates an example portion of a fluid ejection die with a fluid ejector type actuator and a recirculation type actuator. In some examples, the fluid ejector type actuator is a HDW fluid ejector type actuator. In other examples, the fluid ejector type actuator is a LDW fluid ejector type actuator. In yet other examples, the fluid ejection die can include both a HDW fluid ejector type actuator and a LDW fluid ejector type actuator.

As illustrated in FIG. 4, the example portion of a fluid ejection die includes fluid reservoir 416. Fluid reservoir 416 is associated with actuator group 402, 404, 406 and 408. Actuator group 402 and 406, together represent a column of actuators, and actuator group 404 and 410, together represent another column of actuators. Each actuator group 402, 404, 406 and 408 can include firing components (e.g., 414A-414H), fluid actuator elements (e.g., 412A-412H), fluid ejector type actuators (e.g., 410A, 410C, 410E, 410G) and recirculation type actuators (e.g., 410B, 410D, 410F, and 410H). As illustrated in FIG. 4, in some examples, each fluid ejector type actuator can be operatively coupled to a recirculation type actuator through a fluidic channel (e.g., 418, 420, 422, 424, 426, 428, 430, 432, 434, 436, 438, 440, 442, 444, 446, and 448). For example, fluid ejector type actuator 410C is operatively connected with recirculation type actuator 410D by fluidic channel 416.

Additionally, as illustrated in FIG. 4, each firing component (e.g., 414A-414H) is operatively coupled to a fluid actuator element (e.g., 412A-412H), and each fluid actuator element is operatively coupled to an actuator (e.g., fluid ejector type actuator or recirculation type actuator). For example firing component 414A is operatively coupled to fluid actuator element 412A. Additionally, fluid actuator element 412A is operatively coupled to fluid ejector type actuator 410A. In some examples, each firing component can include FETS (e.g., JEFT or MOSTFET) to drive a signal to a corresponding actuator element.

Figure 5A:
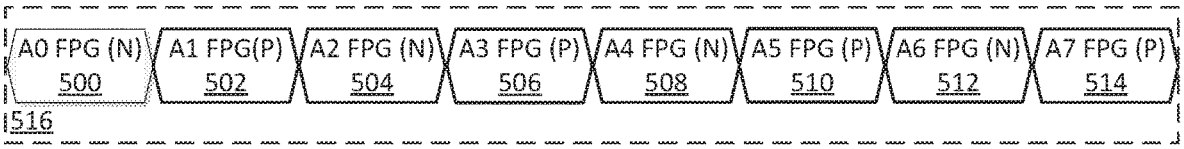
FIG. 5A illustrates an example firing event sequence that includes firing data packets for fluid ejector type actuators and recirculation type actuators.

In examples where the fluid ejection system includes a fluid ejector type actuator and a recirculation type actuator, the firing event sequence includes firing data packets that are addressed to recirculation type actuators and fluid ejector type actuators. For example, FIG. 5A illustrates an example firing event sequence that includes firing data packets addressed to fluid ejector type actuators and recirculation type actuators. As illustrated in FIG. 5A, firing event sequence 516 includes firing data packets or FPG (fire pulse group) 500-FPG 514. Each FPG can include firing data that corresponds to actuating or not actuating ejecting or recirculating actuators. Additionally, each FPG can include identifiers or addresses of an actuator to be actuated. For example, FPG 500 is addressed to a fluid ejector type actuator with the address of A0. If FPG 500 includes firing data that corresponds to actuating actuators, then FPG 500 can control the fluid ejection die or an actuator group to fire/eject a fluid ejector type actuator with the address of A0. In examples where the fluid ejection die includes actuator groups with actuators that share addresses, then a firing data packet that includes an address can cause all actuators with the same address in every actuator group to fire/eject or not fire/eject. For example, a controller (e.g., controller 102) can transmit a firing data packet addressed to A0 to the fluid ejection die. As a result, the fluid ejection die can drive a signal to fire all actuators in each actuator group assigned to the address A0.

However, as described above, recirculation type actuators do not eject fluid. Firing or triggering recirculation type actuators to recirculate would not help purge the fluid ejection system of fluid (e.g., shipping fluid) and instead would waste resources of the fluid ejection system. As such, when the fluid ejection system is initiating or already operating in a service mode to purge fluid (e.g., shipping fluid), the controller can determine and remove firing data packets addressed to recirculation type actuators (e.g., FPG 502, FPG 506, FPG 510, and FPG 514).

In some examples, the fluid ejection system can take into consideration resource limitations of the fluid ejection system when purging its system of fluid (e.g., shipping fluid). Examples of limitations of the fluid ejection system include fluidic limitations, data rate limitations, and power supply and power parasitic limitations. Fluid limitations, based in part on the chamber refill rates, can determine the maximum frequency at which any given actuator can fire.

Power supply and power parasitic limitations can limit how many actuators of a multi-actuator-group fluid ejection die that share addresses, can fire simultaneously, per firing data packet. For example, with reference to FIG. 4, a fluid ejection system can have multiple groups of actuators, and the actuators of each actuator group can share an address (e.g., actuator 410A of actuator group 402, 404, 406 and 408, all share the same address). Additionally, the fluid ejection system can have a power supply limitation that permits 50% of actuators with addresses specified in a firing data packet can fire. Meaning, if a controller (e.g., controller 102) transmits a firing data packet addressed to actuator 410A to the fluid ejection die (e.g., fluid ejection die 104), the fluid ejection die will drive a signal to two out of the four actuator 410A of the four actuator groups (402, 404, 406 and 408). Moreover, to trigger all four actuator 410A to fire, the controller can transmit a second firing data packet addressed to actuator 410A to the fluid ejection die and/or to the actuator groups that have not had an actuator 410A fire yet.

Figure 5B:
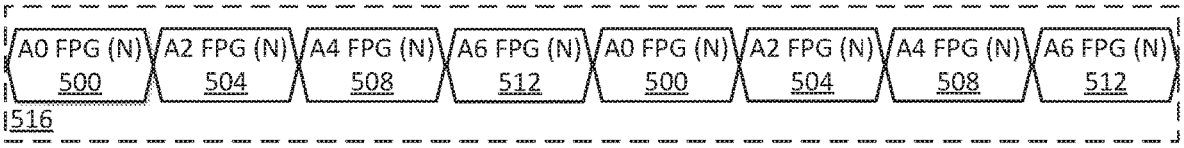
FIG. 5B illustrates an example modified firing event sequence of FIG. 5A.

Data rate limitations can limit the maximum frequency at which firing data packets can be sent to the fluid ejection die at a given time. For example, as illustrated in FIG. 5A and FIG. 5B, the maximum number of firing data packets or the maximum length of the firing event sequence a controller can transmit to a fluid ejection die or actuator group at a given time is 8 firing data packets. In some examples, as similarly described above, removing firing data packets from a firing event sequence can underutilize the resources of the fluid ejection system (e.g., not maximizing the data rate limitations of the fluid ejection system). As such, in such examples, the controller can add more firing data packets to fully utilize the resources of the fluid ejection system.

Examples of a controller adding more data packets to fully utilize the resources of a fluid ejection system is illustrated in FIG. 5B. FIG. 5B illustrates an example modified firing event sequence of FIG. 5A. As described earlier, the controller has removed FPG 502, FPG 506, FPG 510, and FPG 514 (firing data packets associated with recirculation) from firing event sequence 516. As such, to fully utilize the resources of the fluid ejection system, the controller can add additional firing data packets to firing event sequence 516 that are addressed to fluid ejector type actuators (e.g., FPG 500, FPG 504, FPG 508 and FPG 512). As such, the data rate limitation of 8 firing data packets per given time is fully utilized, and the number of actuators that can and are ejecting/purging fluid out of the fluid ejection system has increased (e.g., 8 fluid ejector type actuators are being utilized as opposed to 4 fluid ejector type actuators per actuator group).

Figure 6:
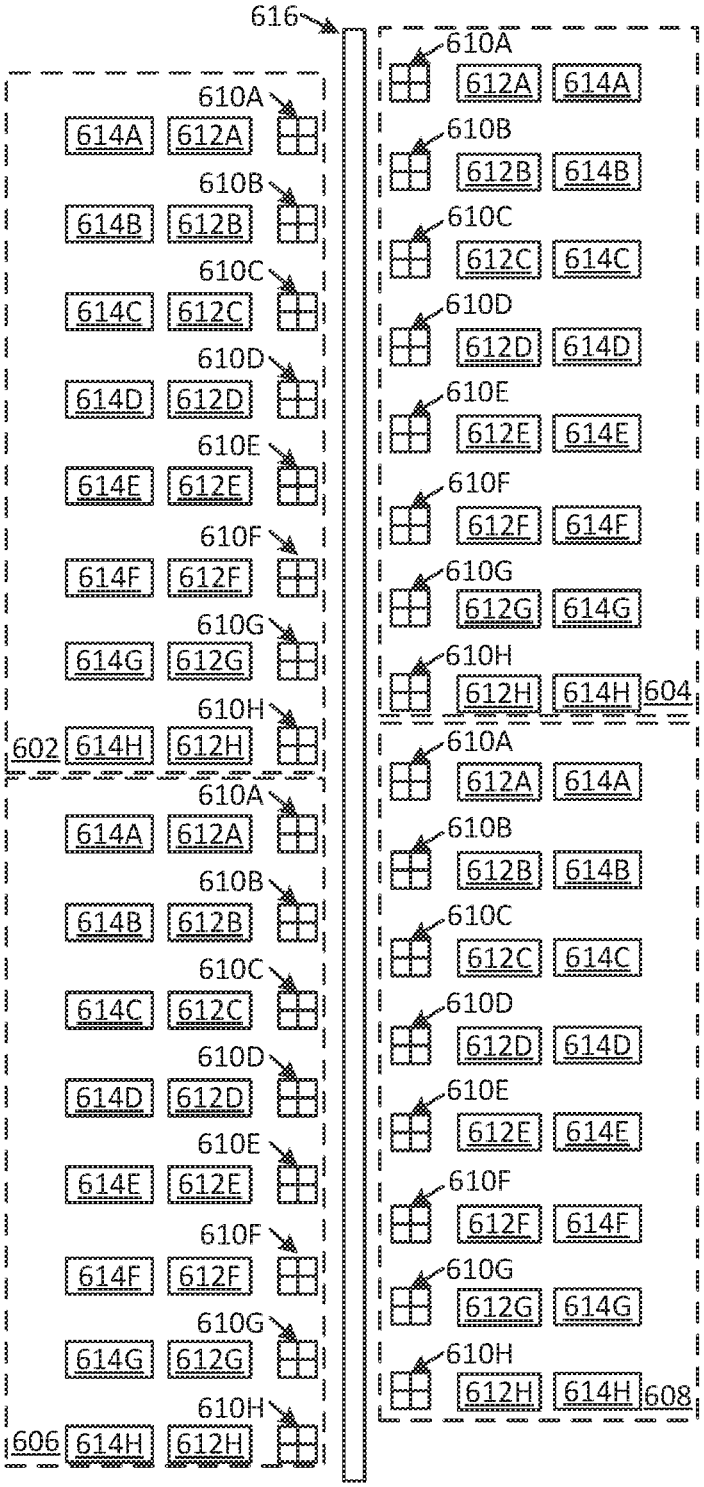
FIG. 6 illustrates an example portion of a fluid ejection die with HDW (high drop weight) fluid ejector type actuators and LDW (low drop weight) fluid ejector type actuators.

In some examples, a fluid ejection system undergoing fluid purge, may include a HDW (high drop weight) fluid ejector type actuator and a LDW (low drop weight) fluid ejector type actuator. FIG. 6 illustrates an example portion of a fluid ejection die with a HDW fluid ejector type actuator and a LDW fluid ejector type actuator. As illustrated in FIG. 6, the example portion of a fluid ejection die includes fluid reservoir 616. Fluid reservoir 616 is associated with actuator group 602, 604, 606 and 608. Actuator group 602 and 606, together represent a column of actuators, and actuator group 604 and 610, together represent another column of actuators. Each actuator group 602, 604, 606 and 608 can include firing components (e.g., 614A-614H), fluid actuator elements (e.g., 612A-612H), HDW fluid ejector type actuators (e.g., 610A, 610C, 610E, 610G) and LDW fluid ejector type actuators (e.g., 610B, 610D, 610F, and 610H).

Additionally, as illustrated in FIG. 6, each firing component (e.g., 614A-614H) is operatively coupled to a fluid actuator element (e.g., 612A-612H), and each firing ejector is operatively coupled to an actuator (e.g., HDW fluid ejector type actuator or LDW fluid ejector type actuator). For example firing component 614A is operatively coupled to fluid actuator element 612A and fluid actuator element 612A is operatively coupled to HDW fluid ejector type actuator 610A. In some examples, each firing component (e.g., 614A-614H) can include FETS (e.g., JEFT or MOSTFET) to drive a signal to a corresponding actuator element (e.g., 612A-612H).

Figure 7A:
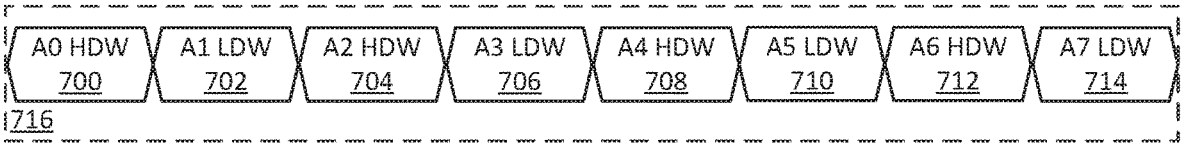
FIG. 7A illustrates an example firing event sequence that includes firing data packets for HDW fluid ejector type actuators and LDW fluid ejector type actuators.

In examples where the fluid ejection system includes a HDW fluid ejector type actuator and a LDW fluid ejector type actuator, the firing event sequence includes firing data packets that are addressed to LDW fluid ejector type actuators and HDW fluid ejector type actuators. For example, FIG. 7A illustrates an example firing event sequence that includes firing data packets for HDW fluid ejector type actuators and LDW fluid ejector type actuators. As illustrated in FIG. 7A, the firing event sequence includes firing data packets or FPG (fire pulse group) 700-FPG 714. Each FPG can include firing data that corresponds to firing/ejecting fluid or to not fire/eject fluid. Additionally, each FPG can include identifiers or addresses of an actuator to be fired. For example, FPG 700 is addressed to a HDW fluid ejector type actuator with the address of A0. Additionally FPG 700 can include firing data that corresponds to firing/ejecting fluid. Taken together, FPG 700 can control the fluid ejection die or an actuator group to fire a HDW fluid ejector type actuator with the address of A0.

However, as described above, LDW fluid ejector type actuators do not eject as much fluid (e.g., shipping fluid) as HDW fluid ejector type actuators. Firing the LDW fluid ejector type actuators to purge fluid from the fluid ejection die would not be as efficient as firing the HDW fluid ejector type actuators to purge/eject fluid from the fluid ejection die. As such, when the fluid ejection system is initiating or already operating in a service mode to purge fluid (e.g., shipping fluid), the controller can determine and remove firing data packets addressed to LDW fluid ejector type actuators (e.g., FPG 702, FPG 706, FPG 710, and FPG 714).

Figure 7B:
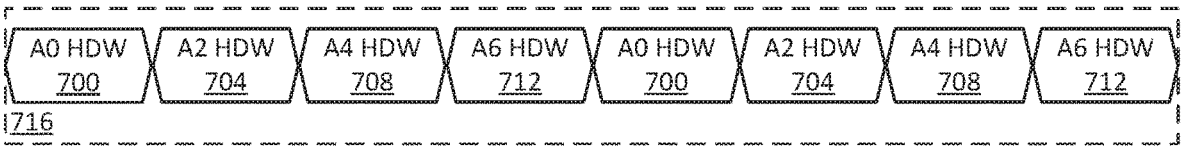
FIG. 7B illustrates an example modified firing event sequence of FIG. 7A.

Examples of a controller can add more firing data packets to fully utilize the resources of a fluid ejection system (e.g., maximizing the data rate limits of the fluid ejection system), is illustrated in FIG. 7B. FIG. 7B illustrates an example modified firing event sequence of FIG. 7A. As described earlier, the controller has removed FPG 702, FPG 706, FPG 710, and FPG 714 (firing data packets associated with recirculation) from firing event sequence 716. As such, to fully utilize the resources of the fluid ejection system (e.g., to maximize the data rate limits), the controller can add additional firing data packets to firing event sequence 716 that are addressed to HDW fluid ejector type actuators (e.g., FPG 700, FPG 704, FPG 708 and FPG 712). As such, the resources of the fluid ejection system can be fully utilized (e.g., by utilizing the maximum data rate of the fluid ejection system), and more efficient actuators are ejecting/purging fluid out of the fluid ejection system.

Utilizing HDW fluid ejector type actuators consume more available resources (e.g., power) of the fluid ejection system than utilizing LDW fluid ejector type actuators. In some examples, a fluid ejection system that utilizes a firing event sequence with firing data packets addressed to only HDW fluid ejector type actuators (e.g., firing event sequence 716 of FIG. 7B), can result in consumption of a higher peak power than a firing event sequence with firing data packets addressed to only LDW fluid ejector type actuators or to LDW fluid ejector type actuators and HDW fluid ejector type actuators. In such examples, the controller can further modify the firing event sequence by adding to the firing data packets addresses of LDW fluid ejector type actuators.

Figure 7C:
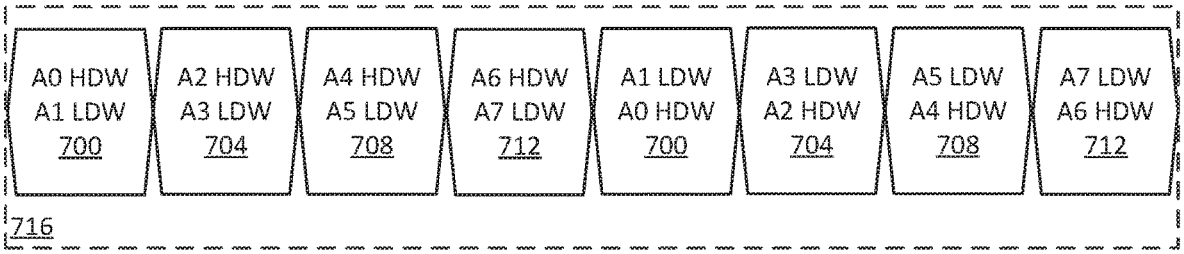
FIG. 7C illustrates an example modified firing event sequence of FIG. 7B.

Examples of a controller adding addresses or identifiers of to LDW fluid ejector type actuators to the HDW fluid ejector type actuator associated firing data packets of a firing event sequence, is illustrated in FIG. 7C. FIG. 7C illustrates an example modified firing event sequence of FIG. 7B. In such examples, the controller can add to FPG 700, FPG 704, FPG 708 and FPG 712, addresses of the removed LDW fluid ejector type actuators. For example, the controller can add the A1 address of LDW fluid ejector type actuator to FPG 700; the controller can add the A3 address of LDW fluid ejector type actuator to FPG 704; the controller can add the A5 address of LDW fluid ejector type actuator to FPG 708; and the controller can add the A7 address of LDW fluid ejector type actuator to FPG 712. As a result, there will be a lower peak power consumed by the fluid ejection system and greater utilization of all the fluid ejector type actuators of a fluid ejection die that includes HDW and LDW fluid ejector type actuators.

In some examples, the fluid ejection system can further specify which column which HDW or LDW fluid ejector type actuator is to be fired. In such examples, the fluid ejection die can include multiple columns of actuators (e.g., FIG. 6). In some examples each column of actuators can include multiple groups of actuators. In such examples, the controller can further include in each firing data packet of the firing event sequence, a column identifier or an actuator group identifier associated with the address assigned to each HDW or LDW fluid ejector type actuator. For example, referring to FIG. 6 and FPG 700 of FIG. C, a controller can specify the HDW fluid ejector type actuators with the address A0 (e.g., HDW fluid ejector type actuator 610A) and LDW fluid ejector type actuators with address A1 (e.g., LDW fluid ejector type actuator 610B) of the right column are to fire, by including a column identifier associated with the right column into FPG 700. In other examples, again referring to FIG. 6 and FPG 700 of FIG. 7C, a controller can specify the HDW fluid ejector type actuators with the address A0 (e.g., HDW fluid ejector type actuators 610A) and LDW fluid ejector type actuators with address A1 (e.g., LDW fluid ejector type actuator 610B) of actuator group 602 and 604 respectively are to fire, by including actuator group identifiers associated with actuator group 602 and 604 into FPG 700.

Methodology

Figure 8A:
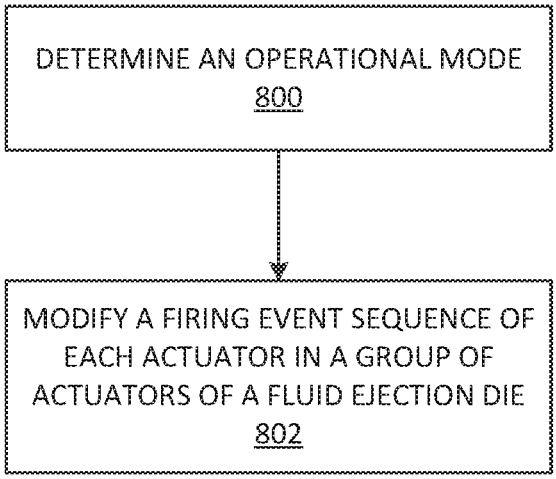
FIG. 8A illustrates an example method for purging fluid from a fluid ejection system.
Figure 8B:
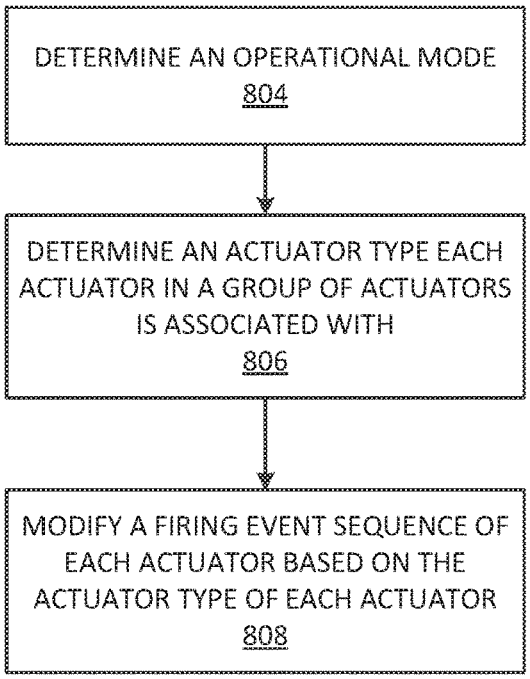
FIG. 8B illustrates an example methods for purging fluid from a fluid ejection system based on an actuator type of each actuator.
Figure 8C:
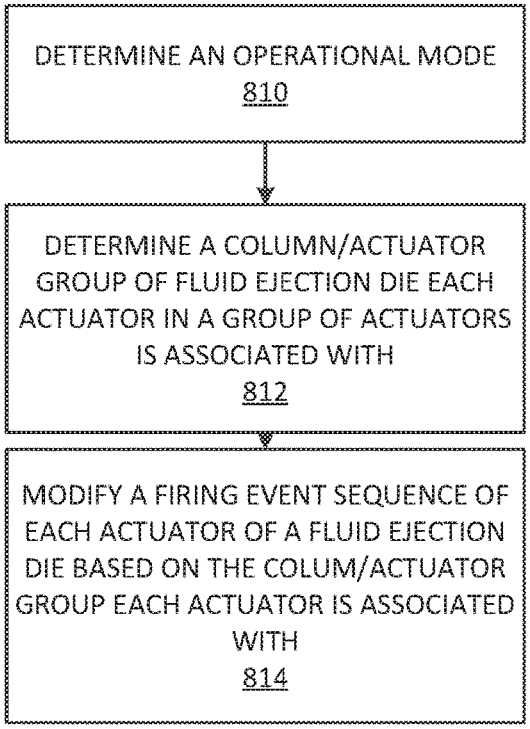
FIG. 8C illustrates an example methods for purging fluid from a fluid ejection system based on the column and/or actuator group of a fluid ejection die associated with each actuator.
Figure 8D:
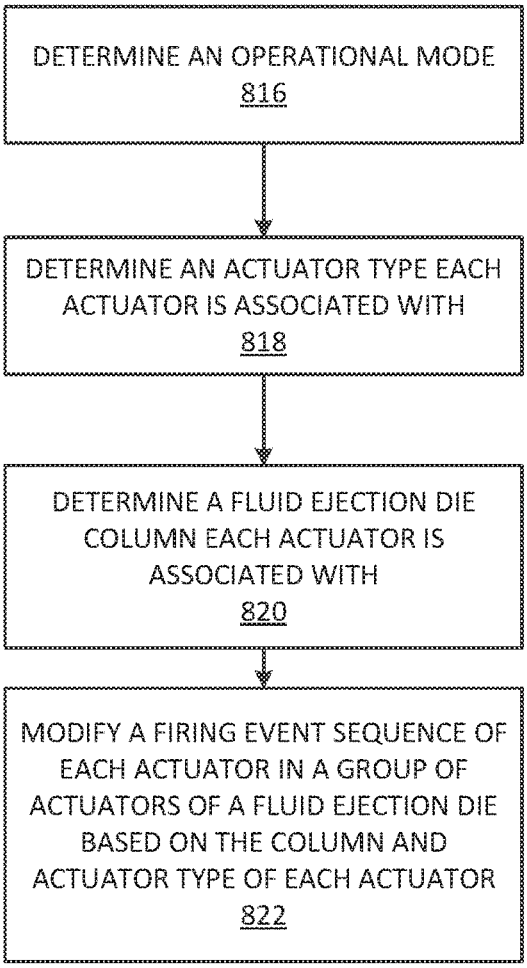
FIG. 8D illustrates an example methods for purging fluid from a fluid ejection system based on actuator type and column and/or actuator group of a fluid ejection die associated with each actuator.

FIG. 8A illustrates an example method for purging fluid from a fluid ejection system. FIG. 8B illustrates an example methods for purging fluid from a fluid ejection system based on an actuator type of each actuator. FIG. 8C illustrates an example methods for purging fluid from a fluid ejection system based on the column and/or actuator group of a fluid ejection die associated with each actuator. FIG. 8D illustrates an example methods for purging fluid from a fluid ejection system based on actuator type and column and/or actuator group of a fluid ejection die associated with each actuator. As herein described a firing event is when a drive bubble device ejects/fires/recirculates fluid. In the below discussions of FIG. 8A-8D may be made to reference characters representing like features as shown and described with respect to FIGS. 1, 4, 5A, 5B, 6, 7A and 7B for purposes of illustrating a suitable component for performing a step or sub-step being described.

FIG. 8A illustrates an example method for purging fluid from a fluid ejection system. In some examples, fluid ejection system 100 can determine an operational mode (800). For example, controller 102 can determine an operational mode fluid ejection system 100 is to perform or is currently performing. Examples of operational modes include normal mode and service mode. The service mode can include fluid ejection system 100 purging fluid (e.g., shipping fluid) from fluid ejection die 104.

In some examples, fluid ejection system 100 can include fluid ejection die 104 that includes multiple columns of actuators. In other examples, fluid ejection die 104 can include multiple groups of actuators. In yet other examples, fluid ejection die 104 can include multiple columns of actuators and each column of actuators can include multiple groups of actuators. For example, with reference to FIG. 4, the illustrated example portion of a fluid ejection die (e.g., fluid ejection die 104) can include actuator group 402, 404, 406 and 408. Actuator group 402 and 406, together represent a column of actuators, and actuator group 404 and 410, together represent another column of actuators.

In response to fluid ejection system 100 determining fluid ejection system 100 is in a service mode, fluid ejection system 100 can modify firing event sequence 108 of each actuator in a group of actuators (802). In some examples, the modification of firing event sequence 108 can be based in part on the determination that fluid ejection system 100 is operating in the service mode.

Controller 102 can modify firing event sequence 108 associated with a normal mode of operations, for a more efficient fluid (e.g., shipping fluid) purge. In some examples, controller 102 can modify firing event sequence 108 based on an actuator type of each actuator. Examples of actuator types include a recirculation type actuator and a fluid ejector type actuator. The recirculation type actuator does not include an orifice and may recirculate or pump fluid within one or more chambers of the recirculation type actuator when fired. The fluid ejector type actuator includes an orifice and when fired, can eject drops of fluid (e.g., shipping fluid or ink) from the chamber through the orifice. In some examples, the fluid ejector type actuator can be a HDW (high drop weight) fluid ejector type actuator. In other examples, the fluid ejector type actuator can be a LDW (low drop weight) fluid ejector type actuator. The HDW fluid ejector type includes an orifice with a larger orifice to eject higher weighted or larger sized fluid drops than the LDW fluid ejector type actuator. In some examples, the recirculation type actuator can be operatively connected to an ejector type actuator with a fluidic channel. In such examples, the recirculation type actuator may recirculate or pump fluid within one or more chambers of the proximate ejector actuator(s) when fired.

In other examples, controller 102 can modify firing event sequence 108 based on a column and/or actuator group of fluid ejection die 104 each actuator is associated with. In yet other examples, controller 102 can modify firing event sequence 108 based on an actuator type and a column and/or actuator group of fluid ejection die 104 each actuator is associated with.

Fluid ejection system 100 can utilize the modified firing event sequence 108 to purge fluid (e.g., shipping fluid) from fluid ejection die 104. For example controller 102 can transmit the modified firing event sequence 108 to fluid ejection die 104 to purge fluid from fluid ejection die 104. In response to fluid ejection die 104 receiving firing event sequence 108, fluid ejection die 104 can control actuator(s) 106 to fire/purge fluid.

FIG. 8B illustrates an example methods for purging fluid from a fluid ejection system based on actuator type. In some examples, similar to the principles as previously described, fluid ejection system 100 can determine an operational mode (804). In response to fluid ejection system 100 determining fluid ejection system 100 is in a service mode, fluid ejection system 100 can determine an actuator type each actuator is associated with (806). For example, controller 102 can determine the actuator type associated with the address or identifier of each actuator in a group of actuators (e.g., fluid ejector type actuator, a recirculation type actuator, HDW fluid ejector type actuator or a LDW fluid ejector type actuator).

Additionally, in response to fluid ejection system 100 determining fluid ejection system 100 is in a service mode, fluid ejection system 100 can modify firing event sequence 108 of each actuator in a group of actuators, based on the actuator type of each actuator (808). For example, after controller 102 determines the actuator type associated with the address or identifier of each actuator, controller 102 can modify firing event sequence 108 based on the actuator type associated with the address or identifier of each actuator.

In some examples, fluid ejection system 100 undergoing fluid purge (service mode), may include a fluid ejector type actuator and a recirculation type actuator. As noted above, recirculation type actuators do not eject fluid and if fired would not help purge fluid and waste resources of the fluid ejection system. In such examples, fluid ejection system 100 can modify firing event sequence 108 to make fluid purge more efficient by removing data firing packets addressed to recirculation actuators. With reference to FIGS. 5A and 5B, for example, controller 102 can determine firing data packets that include addresses to recirculation type actuators. As such, controller 102 can remove firing data packets addressed to LDW fluid ejector type actuators. The same principles can be applied to fluid ejection system 100 undergoing going fluid purge (service mode) and including HDW fluid ejector type actuators and LDW fluid ejector type actuator.

Moreover, in some examples, resource limitations (e.g., fluidic limitations, data rate limitations, and power supply and power parasitic limitations) of fluid ejection system 100 can be taken into account when modifying firing event sequence 108. For example with reference to FIGS. 5A and 5B, controller 102 can remove firing data packets all addressed to recirculation type actuators (e.g., FPG 502, FPG 506, FPG 510, and FPG 514) because recirculation type actuators do not further purging fluid from fluid ejection system 100. As such, controller 102 can add (and has added) additional firing data packets addressed to fluid ejector type actuators (e.g., FPG 500, FPG 504, FPG 508 and FPG 512) to firing event sequence 516 to maximize data rates given the previously described data rate limitations. In another example, with reference to FIGS. 7A and 7B, controller 102 can remove firing data packets all addressed to LDW fluid ejector type actuators (e.g., FPG 702, FPG 706, FPG 710, and FPG 714) because LDW fluid ejector type actuators are not as efficient in purging fluid from fluid ejection system 100 as HDW fluid ejector type actuators. As such, controller 102 can add (and has added) additional firing data packets addressed to HDW fluid ejector type actuators (e.g., FPG 700, FPG 704, FPG 708 and FPG 712) to firing event sequence 716 to maximize data rates given the previously described data rate limitations.

FIG. 8C illustrates an example method for purging fluid from a fluid ejection system based on a column and/or actuator group of a fluid ejection die each actuator is associated with. Similar to the example method illustrated in FIG. 8B, in some examples fluid ejection system 100 can determine an operational mode (810). In response to fluid ejection system 100 determining fluid ejection system 100 is in a service mode, fluid ejection system 100 can determine a column identifier and/or an actuator group identifier of fluid ejection die 104 each actuator 106 of an actuator group is associated with (812). Additionally, in response to fluid ejection system 100 determining fluid ejection system 100 is in a service mode, fluid ejection system 100 can modify firing event sequence 108 of each actuator in a group of actuators, based on the column identifier and/or actuator group identifier each actuator 106 is associated with (814).

FIG. 8D illustrates an example method for purging fluid from a fluid ejection system based on an actuator type and a column and/or actuator group of a fluid ejection die each actuator is associated with. Similar to the example method illustrated in FIGS. 8B and 8C, in some examples fluid ejection system 100 can determine an operational mode (816). Additionally similar to the example method illustrated in FIG. 8B, fluid ejection system 100 can determine an actuator type each actuator is associated with (818). Additionally, similar to the example method illustrated in FIG. 8C fluid ejection system 100 can determine a column identifier and/or actuator group identifier of fluid ejection die 104 each actuator 106 of an actuator group is associated with (820). Moreover, in response to fluid ejection system 100 determining fluid ejection system 100 is in a service mode, fluid ejection system 100 can modify firing event sequence 108 of each actuator in a group of actuators, based on the actuator type and the column identifier and/or actuator group identifier each actuator 106 is associated with (822).

In some examples, fluid ejection system 100 undergoing fluid purge (e.g., service mode), may include HDW fluid ejector type actuators and LDW fluid ejector type actuators. As noted above, utilizing HDW fluid ejector type actuators can consume more available resources of fluid ejection system 100 than utilizing LDW fluid ejector type actuators. In some examples, fluid ejection system 100 utilizing firing event sequence 108 with only firing data packets addressed to HDW fluid ejector type actuators (e.g., firing event sequence 716 of FIG. 7B), can result in consumption of a higher peak power than firing event sequence 108 with only firing data packets addressed to LDW fluid ejector type actuators or to LDW fluid ejector type actuators and HDW fluid ejector type actuators. In such examples, controller 102 can add to the firing sequence 108 of only firing data packets addressed to HDW fluid ejector type actuators, addresses of LDW fluid ejector type actuators. With reference to FIGS. 7B and 7C, for example, controller 102 can determine the firing data packets are addressed to HDW fluid ejector type actuators. As such, controller 102 can add to the firing data packets addresses of LDW fluid ejector type actuators.

Moreover, in such examples, controller 102 can further specify in the firing data packet of the firing event sequence, a column or a actuator group specific HDW or LDW fluid ejector type actuator. For example, with reference to FIG. 7C, each firing data packet of firing event sequence 716 can include the column identifier or actuator group identifier the HDW fluid ejector type actuator and LDW fluid ejector type actuator are associated with. For instance with further reference to FIG. 6 and FPG 700 of FIG. 7, FPG 700 can include specific column identifiers associated with the A0 address of HDW fluid ejector type actuator and A1 address of LDW fluid ejector type actuator (e.g., the column identifier of the right column of actuators illustrated in FIG. 6). In another instance, again referring to FIG. 6 and FPG 700 of FIG. 7, FPG 700 can include the specific actuator group identifier associated with the A0 address of HDW fluid ejector type actuator and the A1 address of LDW fluid ejector type actuator (e.g., actuator group 602 and actuator group 604 illustrated in FIG. 6, respectively).

In other examples, at the end of the service mode, fluid ejection system 100 may still have some residual unpurged fluid (e.g., shipping fluid) in fluid ejection die 102. In such examples, controller 102 can determine the drop rate of each actuator 106 (e.g., how much fluid is ejected out of each actuator 106 per firing event) and how much fluid was originally installed in fluid ejection system 100. Taken together, controller 102 can determine how much residual unpurged fluid is still in fluid ejection system 100 at the end of the service mode. Additionally, controller 102 can determine the number of firing data packets or firing event sequences should be transmitted to fluid ejection die 106 to ensure total purging of fluid. Such a determination can be based on the amount of residual unpurged fluid controller 102 earlier determined and the drop rate of actuators(s) 106. Moreover, such determinations can be made after controller 102 determines fluid ejection system 100 is at the end of the service mode or is still currently operating in a service mode.

Although specific examples have been illustrated and described herein, it will be appreciated by those of ordinary skill in the art that a variety of alternate and/or equivalent implementations may be substituted for the specific examples shown and described without departing from the scope of the disclosure. This application is intended to cover any adaptations or variations of the specific examples discussed herein.

What is claimed is:

1. A fluid ejection system comprising:

a fluid ejection die including a group of actuators including actuators of a first type and actuators of a second type; and a controller to:

determine whether the fluid ejection system is in a service mode as opposed to a normal mode of operation; and in response to determining the fluid ejection system is in the service mode, modify a firing event sequence associated with the normal mode of operation and including firing of each actuator in the group of actuators to yield a modified firing event sequence that is to include one of: firing of actuators of the first type without firing of actuators of the second type, or concurrent firing of actuators of both the first type and the second type.

2. The fluid ejection system of claim 1, wherein the firing event sequence is to be modified based in part on an actuator type of the actuators of the first type.

3. The fluid ejection system of claim 2, wherein the firing event sequence is also to be modified based on the actuator type of the actuators of the second type.

4. The fluid ejection system of claim 3, wherein the actuator type of the second type comprises recirculation type actuators.

5. The fluid ejection system of claim 3, wherein the actuator type of the second type comprises LDW (low drop weight) fluid ejector type actuators.

6. The fluid ejection system of claim 3, wherein the actuator type of the first type comprises HDW (high drop weight) fluid ejector type actuators.

7. The fluid ejection system of claim 3, wherein the actuator type of the first type or the second type comprises an ejector actuator.

8. The fluid ejection system of claim 1, wherein the controller is further to:

transmit the modified firing event sequence to the fluid ejection die.

9. The fluid ejection system of claim 1, wherein the fluid ejection die further includes a second group of actuators.

10. The fluid ejection system of claim 9, wherein the fluid ejection die includes a first column of one or more groups of actuators and a second column of one or more groups of actuators, and wherein the first column includes the group of actuators and the second column includes the second group of actuators.

11. The fluid ejection system of claim 10, wherein the firing event sequence is determined based in part on a column each actuator is associated with.

12. The fluid ejection system of claim 10, wherein the firing event sequence is determined based in part on a column each actuator is associated with and an actuator type of each actuator.

13. The fluid ejection system of claim 1, wherein a fluid to be purged is shipping fluid.

14. A printer system comprising:

a print-head die including a group of actuators, including actuators of a first type and actuators of a second type; and a controller to:

determine whether the printer system is in a service mode as opposed to a normal mode of operation; and in response to determining the printer system is in the service mode, modify a firing event sequence associated with the normal mode of operation and including firing of each actuator in the group of actuators to yield a modified firing event sequence that is to include one of firing actuators of the first type without firing actuators of the second type, or concurrent firing of actuators of both the first type and the second type.

15. A method for modifying a firing event sequence, the method comprising:

determining whether a fluid ejection system is in a service mode as opposed to a normal mode of operation; and in response to determining the fluid ejection system is in the service mode, modifying the firing event sequence associated with the normal mode of operation and including firing of each actuator in a group of actuators of a fluid ejection die to yield a modified firing event sequence that includes one of: firing of actuators of a first type without firing of actuators of a second type, or concurrent firing of actuators of both the first type and the second type.

16. The printer system of claim 14, wherein the service mode corresponds to a service mode to purge shipping fluid.

17. The printer system of claim 16, wherein the actuators of the first type correspond to ejector type actuators and the actuators of the second type correspond to recirculation type actuators and the modified firing event sequence comprises firing of the ejector type actuators without firing of the recirculation type actuators.

18. The method of claim 15, wherein the modified firing event sequence is to overcome fluidic limitations of the firing event sequence associated with the normal mode of operation.

19. The method of claim 18, wherein the fluidic limitations include a chamber refill rate.

20. The method of claim 15, wherein the modified firing event sequence is to overcome data rate limitations.

* * * * *